US008381673B2

(12) United States Patent
Wirsig

(10) Patent No.: US 8,381,673 B2
(45) Date of Patent: Feb. 26, 2013

(54) WATERCRAFT STABILIZING DEVICE FOR BOARDING OR EXITING

(76) Inventor: Ralph C. Wirsig, Perth Road Village (CA)

( * ) Notice: Subject to any disclaimer, the term of this patent is extended or adjusted under 35 U.S.C. 154(b) by 78 days.

(21) Appl. No.: 13/044,555

(22) Filed: Mar. 10, 2011

(65) Prior Publication Data

US 2011/0297067 A1 Dec. 8, 2011

(51) Int. Cl.
*B63B 21/00* (2006.01)

(52) U.S. Cl. ..... 114/362; 114/230.16

(58) Field of Classification Search ..... 405/3; 114/44, 114/362

See application file for complete search history.

(56) References Cited

U.S. PATENT DOCUMENTS

| | | | | |
|---|---|---|---|---|
| 4,432,664 | A * | 2/1984 | Baldyga | 405/3 |
| 7,182,030 | B2 | 2/2007 | Privette | |
| 7,293,521 | B1 * | 11/2007 | Johns et al. | 114/259 |
| 7,444,952 | B1 * | 11/2008 | McGann | 114/222 |

* cited by examiner

*Primary Examiner* — Edwin Swinehart
(74) *Attorney, Agent, or Firm* — Ronald G. Bitner

(57) ABSTRACT

An apparatus for stabilizing a watercraft for boarding or exiting comprising an elongated cradle arm support member for attaching vertically to a docking structure and a cradle arm for attaching to the cradle arm support member, in which the cradle arm has a generally V-shaped upper surface for cradling the under surface of a watercraft, restricting roll. The cradle arm is adjustably connecting the cradle arm support member, for selectively fixing the arm to the cradle arm support member in one of a range of vertical positions to accommodate changing water levels.

10 Claims, 2 Drawing Sheets

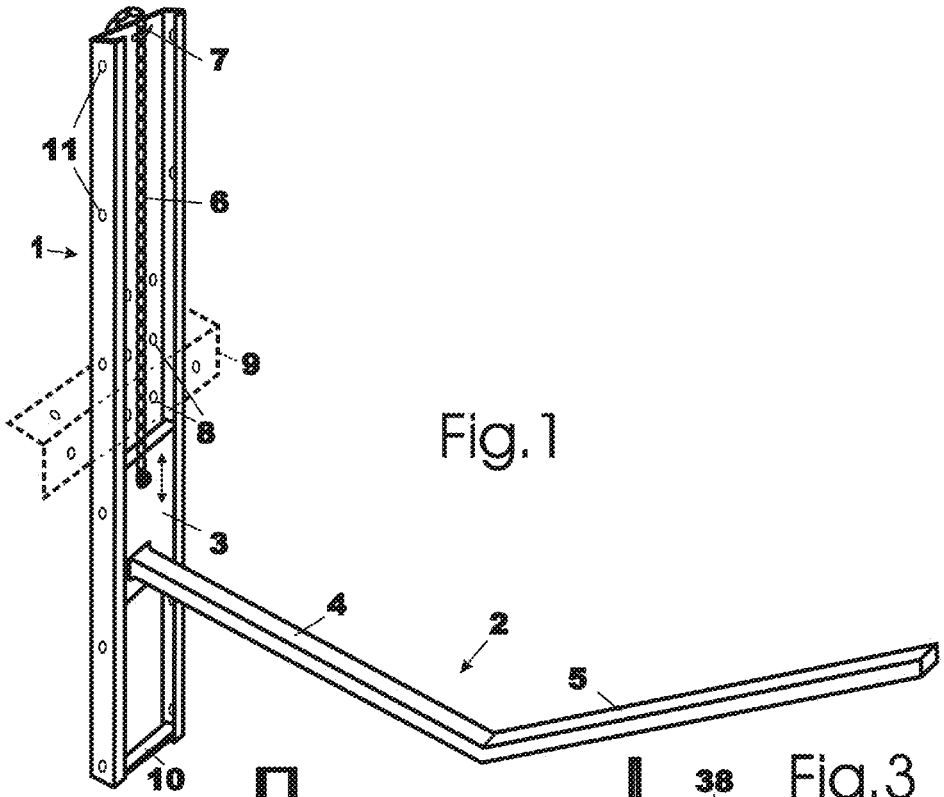
Fig. 1
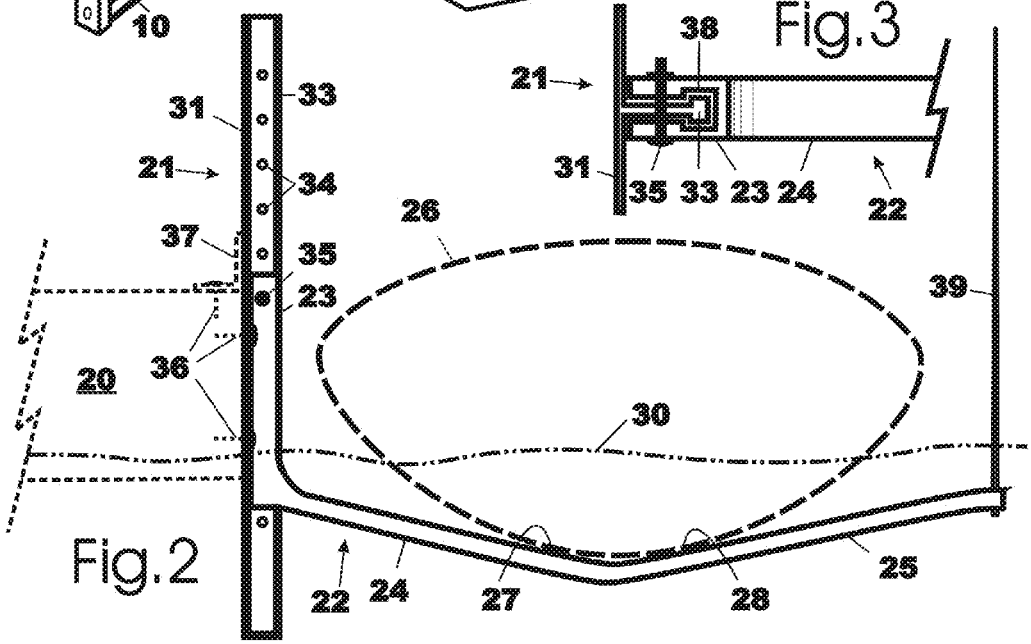
Fig. 2
Fig. 3

WATERCRAFT STABILIZING DEVICE FOR BOARDING OR EXITING

BACKGROUND OF THE INVENTION

1. Field of the Invention

This invention relates to an apparatus that facilitates boarding or exiting from a small watercraft, such as a kayak or canoe.

2. Description of the Prior Art

A difficulty with the use of small watercraft, such as kayaks or canoes, is that they tend to be unstable when the user is boarding or exiting. This is also the case when boarding from a dock, the most common location for launching. Boarding is made even more difficult when the top of the watercraft in the water is not at the same level as the dock. People with reduced upper body strength and flexibility and novice kayakers have great difficulty entering kayaks and even greater difficulty getting out of kayaks.

A technique commonly used by kayakers is the "paddle-bridge" approach which involves the use of a paddle to form a bridge between the dock and kayak that helps stabilize the kayak for boarding. Even for experienced kayakers the "paddle-bridge" approach to entering/exiting a kayak from a dock is difficult if the elevation difference from the top of the dock to the top of the kayak is more than a few inches.

If dock height above the water is unsuitable for the "paddle-bridge" approach to entering/exiting a kayak the alternative of using a suitable shoreline adjacent to shallow water is often not available, and when it is, it usually requires the kayaker to get their feet wet.

Another alternative to an unsuitable dock is entry/exit from a beach where the kayak is positioned part way up the beach thereby providing enough stability to enable the kayaker to step into the kayak before assuming a sitting position. However, as with a suitable shoreline, a beach is often not available and it too usually requires the kayaker to get their feet wet.

U.S. Pat. No. 7,182,030 discloses a "Kayak Launcher" comprising a pair of spaced pontoons with watercraft supports between the pontoons. While such device provides stability for entry into and exit from a kayak similar to a beached kayak, it does so at relatively high expense and requires significant waterfront space.

One of main reasons boarding or exiting is difficult from a dock is due to roll motion of the unsupported watercraft. Accordingly, it would be desirable to provide users with a simple stabilizing device for launching and docking.

SUMMARY OF THE INVENTION

An object of the present invention is to provide a simple device that facilitates boarding and exit from a small watercraft such as a kayak or canoe.

A specific object of the invention is to provide an apparatus adapted for attaching to a docking structure which stabilizes a small watercraft such as a kayak or canoe while boarding for launch, or exiting.

It has been found that a kayak or canoe can be stabilized for boarding/exiting with the use of a simple cradle arm attached adjustably to a docking structure.

Specifically, the present invention provides an apparatus for stabilizing a watercraft for boarding or exiting comprising an elongated cradle arm support member for attaching vertically to a docking structure; a cradle arm for adjustably attaching to the cradle arm support member; said cradle arm including sloping watercraft supporting portions defining a generally V-shaped upper surface for contacting the under surface of the watercraft at laterally spaced regions, for restricting roll; and interconnecting means adjustably connecting the cradle arm to the cradle arm support member, including means for selectively fixing the cradle arm to the cradle arm support member in a selected vertical position, providing for vertical positioning of the cradle arm relative to water level.

BRIEF DESCRIPTION OF THE DRAWINGS

FIG. 1 is a perspective view illustrating one embodiment of the apparatus according to the present invention.

FIG. 2 is a schematic view of another embodiment of the invention showing the apparatus attached to a docking structure with a watercraft positioned for boarding or exiting.

FIG. 3 is a top view of a portion of the apparatus of FIG. 2 showing details of the connection between the cradle arm support member and the cradle arm.

DESCRIPTION OF THE PREFERRED EMBODIMENTS

Figures 4, 5:
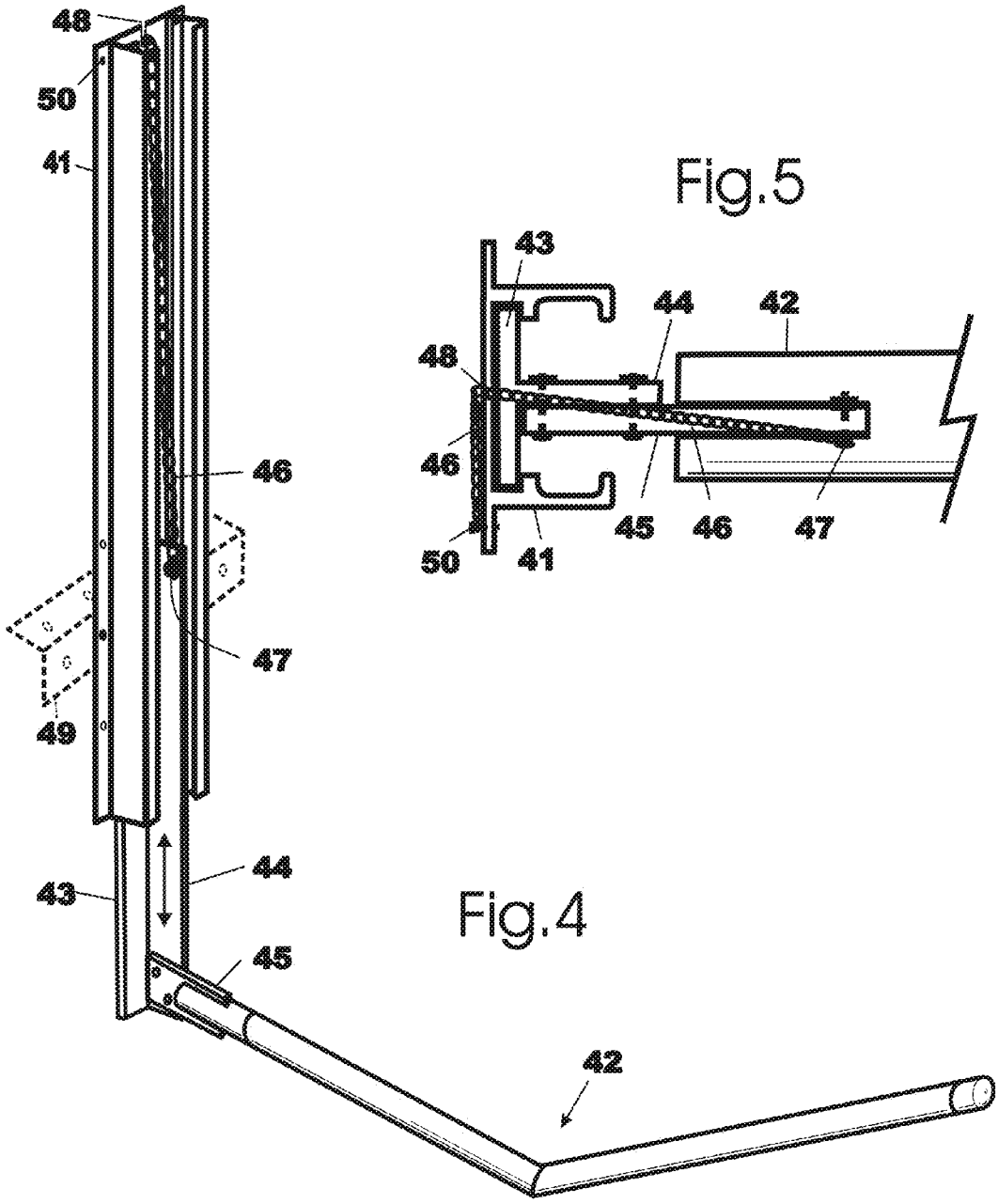
FIG. 4 is a perspective view illustrating another embodiment of the present invention.
FIG. 5 is a top view of a portion of the apparatus of FIG. 4 showing details of the connection between the cradle arm support member and the cradle arm.

With reference to FIG. 1, the present invention comprises an elongated cradle arm support member 1, for attaching to a docking structure, and a cradle arm 2 adjustably connected to the cradle arm support member 1.

The cradle arm support member 1 can be attached to a docking structure in any convenient manner, such as screws or bolts. In FIG. 1 the cradle arm support member 1 is shown optionally provided with a bracket 9 and/or apertures 8 facilitating attachment to a docking structure, or other structure suitable for launching. Apertures 11 on the side of the support member 1 may be used to attach the support member 1 in other ways, such as to an upright portion of a ladder, which would be advantageous when the water level is substantially below that of the dock.

The cradle arm 2 includes sloping portions 4 and 5 defining a generally V-shaped upper surface for contacting the under surface of a watercraft at laterally spaced regions, as can be best seen with reference to the embodiment shown in FIG. 2.

The cradle arm 2 is adjustably connected to the cradle arm support member 1 by a suitable connector mechanism which in FIG. 1 is shown in the form of a shoe member 3, attached to one end of the cradle arm 2, and slidably retained in a track or channel integral with the support member 1, providing for adjustment along a longitudinal axis of the support member 1. The cradle arm 2 is shown held in a selected vertical position by a chain 6 that can be attached to the support member 1 by means of a pin, bolt or hook 7. This arrangement provides the means for selectively fixing the cradle arm 2 to the cradle arm support member 1, and provides for convenient above the water level height adjustment of the cradle arm 2.

The cradle arm support member 1 is shown to include a stop member 10 at the bottom to prevent the shoe/arm assembly from accidentally falling out when the chain is detached for arm height adjustment.

Various methods may be used to provide vertical adjustability of the cradle arm relative to the cradle arm support member.

FIG. 2 illustrates another embodiment of the present invention with the cradle arm support member 21 shown attached to a docking structure 20. Attached to the cradle arm support member 21 is a vertically adjustable cradle arm 22.

The cradle arm 22 includes sloping portions 24 and 25 defining a generally V-shaped upper surface for contacting the under surface of the watercraft 26 at laterally spaced regions 27 and 28. The two spaced contact points 27 and 28 on the hull and the buoyancy of the hull located behind the arm function as a tripod. The two support points 27 and 28 prevent roll of the watercraft, providing a stable platform for ease of entry and exit.

For most watercraft of interest, the intersecting sloping portions 24 and 25 are preferably linear, or near linear, to conveniently provide the desired spaced apart contact regions 27 and 28 for a variety of watercraft hull shapes.

As shown, the V-shaped cradle arm comprises a pair of substantially linear sloping portions having an intersecting included angle such that the watercraft is supported on both sides of centre at separated regions. Suitable intersecting angles for the sloping portions for a variety of watercrafts appears to be included angles in the range of from about 130 to 160°, and for most in the range of from about 146 to 152°. A cradle arm with a fixed angle of 146° was found to be suitable in providing the desired spaced apart contact regions for stability, when used with a kayak or canoe.

With reference to FIGS. 2 and 3, the cradle arm support member 21 can be a T or I shaped upright with flange 31 adapted to be attached to the dock 20 by suitable means, either directly with suitable fastener 36, or optionally with an attached bracket 37. Support member 21 is shown provided with a series of apertures 34 for receiving a suitable fastener 35 that fixes the end portion 23 of cradle arm 22 to support member 21.

With specific reference to FIG. 3, the cradle arm 22 includes a bifurcated connector end portion 23 adapted to be connected to the cradle arm support member 21 by a suitable fastener, such as a bolt or pin 35 to one of the apertures 34 to provide the desired height of the watercraft supporting portion relative to the level of the water surface 30. The connector end portion 23 is shown extending upward from the cradle arm 22 providing for convenient above the water level height adjustment of the cradle arm 22.

Preferably the support member 21 includes retention means shown in the form of a flange portion 33 that mates with a recess 38 in the connector end portion 23.

Optionally, the outer end of the cradle arm may be provided with a guide member 39 to facilitate the positioning of the watercraft over the cradle arm 22.

An apparatus found to be suitable for a kayak had a cradle arm approximately 30 inches in length with its mid point about 3 inches lower than its ends. The outer portion 25 may be made longer than the inner portion 24 to provide a greater target area for the kayaker when approaching the device for docking.

The cradle arm is fixed in the desired position such that the boat contacting region thereof is below the surface of the water, typically about 2 to 3 inches below the water surface, but dependent on the specific watercraft.

Preferably, the cradle arm is provided with an upper surface that does not damage the hull of the watercraft while launching and docking. This can be in the form of a covering on the cradle arm which can be a low friction material, such as polyethylene pipe, that facilitates sliding and having some measure of resilience for protection of the hull, or the covering can be a highly resilient material, such as polyethylene foam, that facilitates a higher level of protection for the watercraft hull especially in the case of stiff hulls, by spreading the load and thereby reducing the stress on the hull in the contact regions.

FIGS. 4 and 5 illustrate another embodiment showing an alternate arrangement for supporting the cradle arm. FIG. 5 shows details of the connection between the cradle arm support member 41 and the cradle arm 42.

This embodiment has an elongated T-shaped shoe member 43 which allows the cradle arm to extend below the support member 41. This allows for more height adjustment, and/or a shorter support member.

In this embodiment the cradle arm 42 is connected to shoe member 43 by an intermediate connecting plate 45 to flange 44 of shoe member 43, providing a robust interconnection between the cradle arm 42 and shoe member 43.

The cradle supporting shoe member 43 is shown held in position by means of a chain 46. The lower end of the chain is attached to the shoe 43 at 47 while an upper link of the chain is inserted into a slot 48 at the top of the support member 41. The height of the cradle arm can be readily adjusted vertically by selecting the chain link inserted into slot 48.

Preferably, the upper end of the chain 46 will be tethered to a top portion of support member 41 at 50. This limits the downward travel of the shoe 43 and avoids loss of the cradle arm assembly, and also provides a convenient location for the chain to be grasped for arm height adjustments.

As shown the shoe member 43 can be slid vertically out the top of the top of the support member 41. This arrangement allows the shoe/cradle arm assembly to be readily removed so that it does not interfere with other activities near the dock when not in use.

As with the embodiments above, the cradle arm support member 41 can be attached to a docking structure, or other structure suitable for launching, by various means, such as with the use of a bracket 49, as is shown in FIG. 4.

In use, for launching, with specific reference to use with a kayak, the cradle arm is adjusted to a height that puts the boat contacting region of the cradle arm at the desired position below the water surface, typically about 2 to 3 inches below. The kayak is positioned to a location beside the dock and over the cradle arm, such that the cradle arm is located forward of the cockpit of the kayak, and then the kayaker steps into the kayak much as one would step into a flat bottom fishing boat and then proceeds to a normal sitting position. Once the kayaker steps into the kayak pushing the kayak downward, the cradle arm "cradles" the kayak and provides stability. The two separated contact points 27 and 28 on the hull at the front and the buoyancy of the hull located behind the arm function as a tripod, with the front two support points 27 and 28 preventing roll of the kayak. Eliminating roll provides a stable platform for ease of entry and exit.

Optionally, the vertical cradle arm support member may be used by the kayaker as a steadying support during entry, or exit. Once the kayaker is in position the user pushes off, normally backwards, allowing the kayak to slide off the cradle arm and away from the dock.

For docking and exit, the procedure is essentially the reverse of the entry, whereby the kayaker paddles the kayak onto the cradle arm which then once again cradles the kayak in a stable condition beside the dock.

The present invention is especially advantageous for kayakers with reduced upper body strength and flexibility and for novice kayakers who are unable to use or have difficulty in using the conventional "paddle-bridge" approach.

The provision for height adjustment of the cradle arm when used in conjunction with a fixed dock readily maintains functionally over a wide range of water levels due to normal seasonal fluctuations which otherwise could render the conventional "paddle-bridge" approach unworkable. Also, the height adjustability readily enables adaption of the device to floating docks covering a wide a range of dock heights from the water level.

When the watercraft is not in use, a second apparatus similar to one described herein and spaced from the first can be utilized to support the entire craft out of the water on raised cradle arms.

It will be appreciated that mechanisms other than those illustrated herein can be used to provide adjustability of the cradle arm.

Also, the cradle arm can take various forms, for example, in order to adapt it for various or specific watercraft.

It will also be appreciated that the present invention may be used with a variety of docks or structures in the water where a watercraft might be launched. For example, in a case where the water level is considerably lower than the dock, the device can be attached to a ladder that is attached to a dock or other structure.

What is claimed is:

1. An apparatus for stabilizing a watercraft for boarding or exiting consisting of:

a single elongated cradle arm support member for attaching vertically to a docking structure;

a single cradle arm for adjustably attaching to the cradle arm support member;

said cradle arm including sloping watercraft supporting portions defining a generally V-shaped upper surface for contacting the under surface of the watercraft at laterally spaced regions for restricting roll of the watercraft while floating; and interconnecting means adjustably connecting the cradle arm to the cradle arm support member, including means for selectively fixing the cradle arm to the cradle arm support member in a selected vertical position, providing for vertical positioning of the cradle arm relative to water level such that a floating watercraft can slide fore and aft onto and off the cradle arm.

2. The apparatus of claim 1 wherein the interconnecting means comprises a connector portion at one end of the cradle arm adapted to be adjustably connected to the cradle arm support member.

3. The apparatus of claim 2 wherein the interconnecting means includes retention means for keeping the connector portion of the cradle arm slidably attached to the cradle arm support member.

4. The apparatus of claim 3 including limit means for limiting downward travel of the cradle arm to prevent accidental separation of the cradle arm from the cradle arm support member.

5. The apparatus of claim 1 wherein the means for selectively fixing the cradle arm to the cradle arm support is disposed vertically above the watercraft supporting portions, to facilitate adjustability above water level.

6. The apparatus of claim 2 wherein the connector portion is removably connected to the cradle arm support member, in order to facilitate removal of the cradle arm from the support member.

7. The apparatus of claim 1 wherein an outer end of the cradle arm distal from the support member has a guide member to facilitate the positioning of the watercraft over the cradle arm during docking.

8. The apparatus of claim 1 wherein the cradle arm is provided with a resilient upper watercraft contacting surface for protecting the watercraft hull.

9. The apparatus of claim 1 wherein the V-shaped cradle arm comprises a pair of substantially linear sloping portions having an intersecting included angle such that the watercraft is supported on both sides of centre at separated regions, for restricting roll.

10. The apparatus of claim 9 wherein the intersecting included angle ranges from about 130 to 160°.

* * * * *